United States Patent [19]

Couvreur et al.

[11] Patent Number: 4,843,361

[45] Date of Patent: Jun. 27, 1989

[54] ELECTROMAGNET WITH PERMANENT MAGNET HELD BY A CAGE

[75] Inventors: Jean-François Couvreur, Sartrouville; Jacques Olifant, Nanterre, both of France

[73] Assignee: La Telemecanique Electrique, Nanterre Cedex, France

[21] Appl. No.: 218,111

[22] Filed: Jul. 8, 1988

[30] Foreign Application Priority Data

Jul. 16, 1987 [FR] France ..... 87 10057

[51] Int. Cl.[4] ..... H01F 7/08

[52] U.S. Cl. ..... 335/229; 335/230

[58] Field of Search ..... 335/229, 230, 234

[56] References Cited

U.S. PATENT DOCUMENTS 3,614,689 10/1971 Canonne ..... 335/229
4,316,167 2/1982 Koehler ..... 335/229
4,643,393 2/1987 Kosugi et al. ..... 251/129.01

FOREIGN PATENT DOCUMENTS 2358006 2/1978 France .
2460533 1/1981 France .
59-148304 8/1984 Japan .
1246605 9/1971 United Kingdom .

*Primary Examiner*—George Harris
*Attorney, Agent, or Firm*—Young & Thompson

[57] ABSTRACT

A pole piece (14*a*) of the movable core (12) moves in an air gap (25*a*) between external (61) and internal (16) pole pieces. A pole flange (14*b*) of the same core (12) moves in an air gap (25*b*) between a portion (30*b*) of the external pole piece (61) and a magnetic lobe (36) which is in contact with this latter. A permanent return magnet (17) is disposed between the internal (16) and external (61) pole pieces. The magnet (17), the internal pole piece (16) and the lobe (36) are maintained in a cage (60) of plastic material snap fastened by hooks (78, 80) on the external pole piece (61). Three cross pieces (75, 76, 77) connecting two longitudinal walls of the cage to each other, suitably separate the different magnetic components. The force of attraction of the magnet (17) prevents the pole pieces (16, 61) from leaving it.

12 Claims, 2 Drawing Sheets

FIG_1
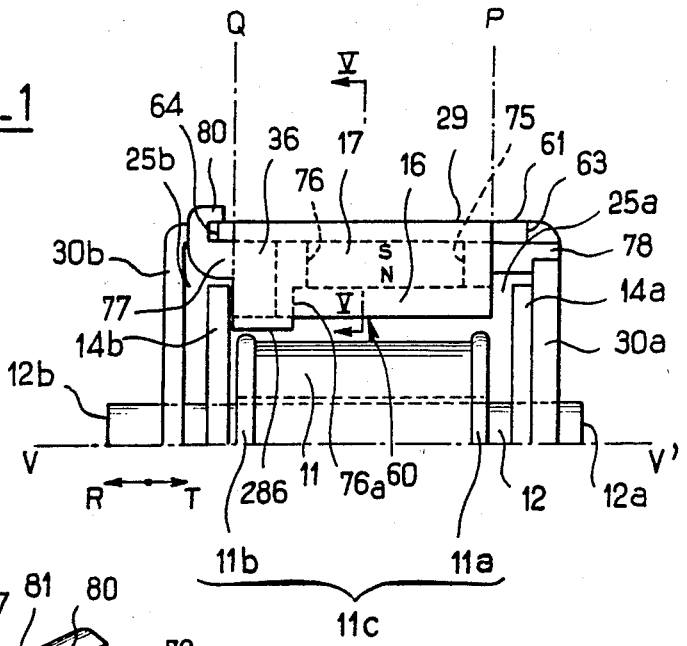
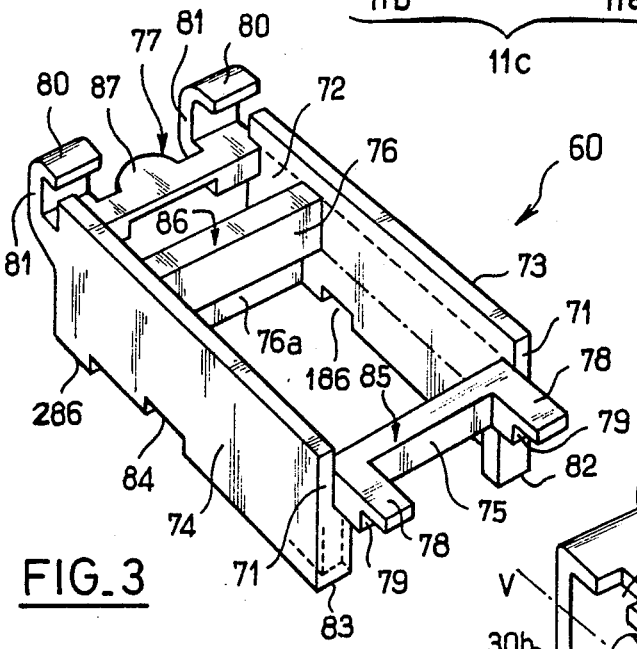
FIG_3
FIG_2
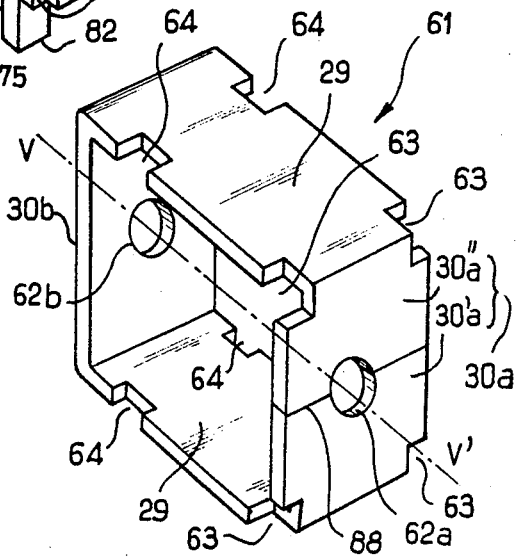

ELECTROMAGNET WITH PERMANENT MAGNET HELD BY A CAGE

The present invention relates to a polarized electromagnet and more particularly to means to maintain the permanent polarizing magnet and various pieces mechanically connected to it.

There are known from FR-A-No. 2 358 006 polarized electromagnets in which a permanent magnet is interposed between an internal pole piece, relatively close to the winding, and an external pole piece farther from the winding. A magnetic core movable axially in the winding carries at each end pole flanges of which at least one is disposed in an air gap between two pole faces belonging respectively to the internal and external pole pieces.

According to whether it is desired to provide a bistable or monostable electromagnet, the other pole flange extends into another air gap between internal and external pole pieces or on the contrary only in the neighborhood of one or two faces of one of the pole pieces at a distance from the other pole piece.

FR-A-No. 2 358 006 is principally concerned with magnetic circuits permitting basically to effect certain functions. But the economical construction of these circuits involves certain problems. Glue connections are not readily accurate and introduce supplemental air gaps. The mechanical securement systems of the type of rivets are costly to provide with precision and affect the magnetic flux.

The object of the invention is thus to provide simple, effective, precise means which are easy to assemble and are free from deleterious effects on the magnetic field, to effect the assembly of the two pole pieces and the permanent magnet in an electromagnet of the designated type.

The invention thus provides an electromagnet comprising an inductive winding and first and second magnetic devices movable with respect to each other, the first device comprising a core surrounded by the winding, the second device comprising an internal pole piece relatively close to the winding, an external pole piece relatively far from the winding, a permanent magnet interposed between the external and internal pole pieces, the core bearing on at least one side of the winding a pole flange disposed in an air gap which separates from each other the internal and external pole pieces.

According to the invention, the electromagnet is characterized by an amagnetic cage snapped on the external pole piece and comprising for the permanent magnet and for the internal pole piece respective recesses defined by positioning and retaining means with respect to movements transverse to the magnetic axis of the permanent magnet.

The method of assembly by snapping in assures precise positioning without difficulty. The cage may thus be positioned with precision relative to the external pole piece. The precise positioning of the internal pole piece can then take place.

The cage positions and retains the pole pieces and the permanent magnet relative to each other with regard to the displacements transversely of the magnetic axis of the permanent magnet. It has indeed been determined according to the invention that the movements in the magnetic direction are effectively countered by the force of attraction exerted by the permanent magnet on each of the pole pieces.

In a preferred embodiment of the invention, opposite a side of the internal pole piece remote from the air gap, the cage defines a recess for a magnetic lobe which is in magnetic contact with the external pole piece and which defines with a transverse region of the external pole piece an air gap in which there is the possibility of relative movement between a second pole flange of the core and the external pole piece, between a position in which the second pole flange bears against the external pole piece and a position in which the second pole flange is adjacent the lobe.

There is thus provided a monostable electromagnet. In fact, in the two positions of the movable device, the second pole flange is magnetically connected to the external pole piece. The permanent magnet tends to retain the mobile device in the position in which the magnetic circuit of the permanent magnet is closed, which is to say the position in which the first pole flange is in contact with the internal pole piece, the magnetic circuit then passing through the core, the first pole flange, the internal pole piece, the permanent magnet, the external pole piece, and the second pole flange.

In this embodiment, the cage maintains the lobe in good position against the external pole piece. This permits providing the external pole piece and the lobe separately from each other from simple primary materials such as sheet metal. FR-A-No-2 358 006 suggests instead to provide the external pole piece and the lobe as a single piece or to assemble them so that they will constitute a single piece, which is complicated from the standpoint of construction.

Other features and advantages of the invention will appear from the following decsription.

In the accompanying drawings, given by way of nonlimiting example:

FIG. 1 is a half-view of an electromagnet according to the invention;

FIG. 2 is a perspective view of the external pole piece;

FIG. 3 is a perspective view of one of the two cages on an enlarged scale;

Figure 4:
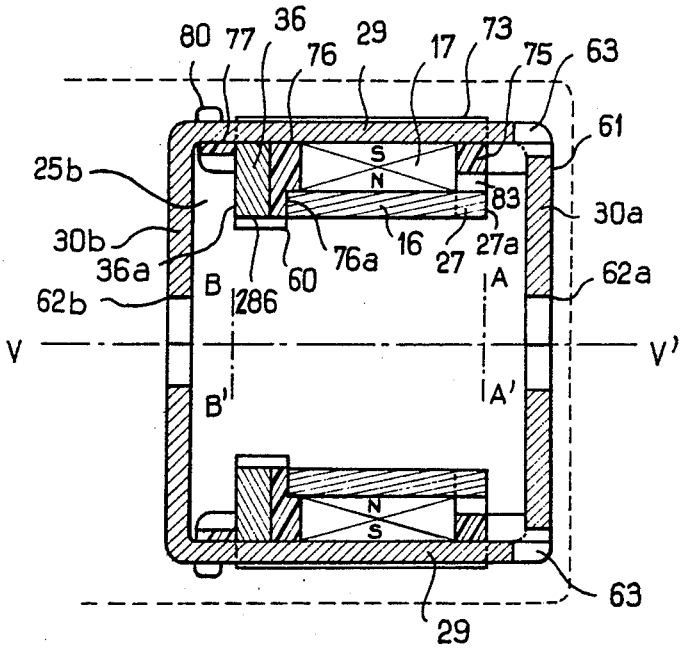
FIG. 4 is an axial cross sectional view of the fixed magnetic device.

In the illustrated example, the electromagnet comprises a winding 11 whose turns are formed on a body 11*c* having end flanges 11*a* and 11*b*.

The first magnetic device, or mobile device, comprises a magnetic core 12 which slides axially in the interior of the winding. The core 12 carries, beyond the flange 11*a* of the winding, a first pole flange 14*a* and, beyond the flange 11*b* a second pole flange 14*b*.

The electromagnet comprises also a second magnetic device—or fixed device—comprising an external pole piece 61 in the form of a rectangular frame whose two opposite faces 30*a* and 30*b* have central holes 62*a* and 62*b* in which are engaged slidably the ends 12*a* and 12*b* of the core 12, situated beyond the pole flanges 14*a* and 14*b*. The external pole piece 61 is made from a strip of magnetic metal bent four times at 90° so that the two ends will be in contact with each other on plane 88 passing through axis VV′ of the winding. The portion 30*a* is thus constituted by two halffaces 30′*a* and 30″*a*. The portions 30*a* and 30*b* are perpendicular to the axis VV′. The two other portions 29 are parallel to the axis VV', and even parallel to the plane of symmetry of the electromagnet, passing through axis VV'.

The face turned toward axis VV' of each portion 29 of the external pole piece 61 is adjacent one of the pole faces, the South pole face for example, of a respective permanent magnet 17. The other pole face of each of the magnets 17, turned toward the axis VV', is adjacent a respective internal pole piece 16.

The face turned toward the axis VV' of each portion 29 of the external pole piece is moreover in magnetic contact with a polar lobe 36 made of a magnetic material and which extends toward the axis VV' between the magnet 17 and the portion 30*b* of the external pole piece 61. Each polar lobe 36 has a parallelepipedal shape which is flattened parallel to the plane of the portion 30*b*. The free distance between the portion 30*b* and the face 36*a* of the polar lobe 36 turned toward the portion 30*b* is equal to the free distance between the portion 30*a* and an end face 27*a* which each internal pole piece 16 presents to the portion 30*a*. Each lobe 36 is spaced from the magnet 17 and the neighboring internal pole piece 16.

The pole flange 14*a* of the core 12 is engaged in two air gaps 25*a* formed each between the end face 27*a* of one of the pieces 16 and the portion 30*a* of the external pole piece 61. The other pole flange 14*b* of core 12 is disposed in the air spaces 25*b* provided each by the face 36*a* of one of the lobes 36 and the portion 30*b* of the external pole piece 61. Moreover, the spacing between the pole flanges 14*a* and 14*b* is such that when the pole flange 14*a* is in contact with the portion 30*a*, the pole flange 14*b* is in contact with the lobes 36 and, when the pole flange 14*a* is in contact with the face 27*a* of the internal pole pieces 16, the pole flange 14*b* is in contact with the portion 30*b* of the external pole piece 61.

Thus, when the winding is energized, having account for the direction of circulation of the current relative to the direction of winding of the coils, the core 12 is urged toward the first of the positions which has been described (the position shown in FIG. 1) in which there is created a closed or substantially closed magnetic circuit passing through the core 12, the pole flange 14*a*, the external pole piece 61, the lobe 36, the pole flange 14*b*. This magnetic circuit does not pass through the permanent magnets 17. For this reason when the winding 11 is deenergized, the magnets 17 returns the mobile device toward the second position mentioned, in which the first pole flange 14*a* is in contact with the internal pole pieces 16 while the second pole flange 14*b* is in contact with the portion 30*b* of the external pole piece 61, such that the magnetic circuit is closed through the permanent magnets 17, which, like the internal pole pieces 16, are mounted magnetically in parallel with each other.

According to the invention, to ensure the mechanical cohesion of the fixed magnetic device, there is provided for each assembly comprising one of the portions 30*a* or 30*b* of the external pole pieces 61, and the magnet 17, the internal pole piece 16 and the associated lobe 36, a securing cage 60.

Figure 5:
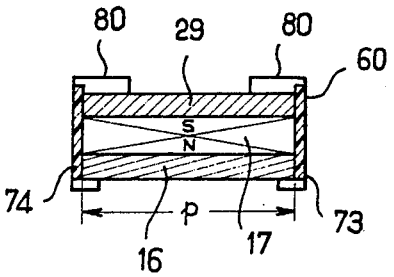
FIG. 5 is a cross sectional view on the line V—V of FIG. 1.

Each cage 60 comprises two longitudinal walls 73, 74 parallel to the axis VV' and perpendicular to the planes of the portions 29. The free space between the walls 73, 74 is equal to the width p (FIG. 5) of the portions 29 of the external pole piece 61. In operation, the walls 73, 74 are on opposite sides of the associated portion 29. The outer edge of the walls 73, 74 is flush with the external face of the portion 29. Coplanar faces 85, 86, 87 of three cross pieces 75, 76, 77 connecting to each other the walls 73, 74 are adjacent to the internal face of the portion 29.

The two end cross pieces 75 and 77 carry hooks 78 and 80, respectively, adapted to cooperate with recesses 63 and 64, respectively, of the pole piece 61 to snap fasten the cage 60 against the internal face of the portion 29 in the position described above.

The hooks 78 carried by the cross piece 75 are positioning lugs directed toward the wall 30*a*. Said lugs are engaged substantially without play transverse to VV', in the recesses 63 provided in the pole piece 61 at the two ends of the edge between the associated portion 29 and the portion 30*a*. On their side remote from face 85, the lugs 78 have a shoulder 79 adapted to bear against the internal face of the portion 30*a* to define with precision the position of the cage relative to the external pole piece in the direction VV'.

Each hook 80 forms with the cross piece 77 which carries it a U-shaped configuration opening toward the portion 30*a*. Each hook 80 is adapted to engage in a recess 64 in the edge of the portion 29, so that the end portion of each hook 80 bears on the external surface of the portion 29 while the central region 81 of the U-shaped configuration bears elastically with its external face against the corresponding edge of the recess 64 so as to press the cage elastically to bring its shoulders 79 to bear against the portion 30*a*.

The cross pieces 75 and 76 define between them a recess having exactly the dimensions of the permanent magnet 17.

Figure 6:
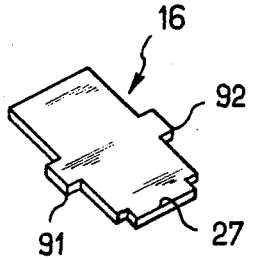
FIG. 6 is a perspective view of the internal pole piece.

Moreover, the intermediate cross piece 76 is elongated towards axis VV' by a wing 76*a* extending to the internal edge of each longitudinal wall 73 or 74. The internal pole piece 16 is disposed between this wing 76*a* and two flanges 82, 83 directed toward each other, carried by the longitudinal walls 73, 74 between their respective internal edge and the cross piece 75. The free space between the wing 76*a* and the flanges 82, 83 is equal to the corresponding dimension of the pole piece 16. However, the pole piece 16 has a protuberance 27 (FIGS. 4 and 6) pointing towards the portion 30*a* and engaged between the flanges 82, 83 so that the external face 27*a* mentioned above is flush with the external face of the flanges 82, 83.

To position more efficiently the piece 16, the latter comprises on its longitudinal edges two opposed ears 91, 92 (FIG. 6) engaged in corresponding recesses 84, 186 (FIG. 3) of the internal edge of the lateral walls 74, 73. When these latter positioning means are provided, the flanges 82, 83 may be omitted and the internal pole piece 16 may extend with its full width up to the level of the corresponding edges 71 of the side walls 73 and 74.

The portion 29, the magnet 17 and the internal pole piece 16 all have a width equal to the free distance between the walls 73 and 74 and are simply stacked between these walls. The walls 73 and 74 and the cross pieces 75 and 76 do not position the portion 29, the magnet 17 and the pole piece 16 with respect to each other except with regard to displacements perpendicular to the magnetic axis of the magnet 17, which is to say parallel to the plane of symmetry of the electromagnet. Thus, it is the magnet 17, by its attractive force, which prevents the pole pieces 29 and 16 from leaving magnet 17. The height of the walls 73 and 74 is such that the internal longitudinal edge of these latter is flush with the internal face of the pole piece 16 in operation.

The cage moreover defines between the cross piece 76 and the cross piece 77 a recess 72 receiving in operation the lobe 36, which is constituted by a mere parallelepipedal rectangle of magnetizable material. The lobe 36 presents toward the axis VV' a face which in operation is in the prolongation of the internal edge of the wing 76*a* and in the prolongation of the internal face of the pole piece 16. To maintain the lobe 36 in this position in which its face turned toward the portion 29 is firmly applied against this latter, each of the longitudinal walls 73 and 74 carries along its internal edge a snap closing lug 286 retaining the polar lobe 36. The cross piece 76 and its wing 76*a* form a partition wall between on the one hand the lobe 36 and on the other hand the magnet 17 and the internal pole piece 16.

So as to reduce the size, the cage 60 maintains the lobe 36 such that its air gap face 36*a* will be substantially in the plane BB' (FIG. 4) of the flange 11*b* (FIG. 1) and maintains the internal pole piece 16 such that its air gap face 27*a* will be substantially in the plane AA' (FIG. 4) of the other flange 11*a* (FIG. 1). Thus, the only noteworthy empty spaces within the electromagnet are those which are necessary for the movement of the pole flanges 14*a* and 14*b*.

Preferably, the cage 60 is made of a single piece of molded plastic material. However, it is conceivable to make at least certain portions of the cage of non-magnetic metal, particularly from a sheet of non-magnetic metal.

Of course, the invention is not limited to the examples shown and described.

The invention is particularly applicable to electromagnets which comprise no lobe such as 36 and whose internal pole piece 16 has two opposed air gap faces, one facing the portion 30*a* such as 27*a* and the other facing the portion 30*b*. In this case, the cage would have the same right portion (such as is shown in the figures) and a left portion symmetrical to the right portion relative to a plane perpendicular to VV', the hooking means however remaining in the structure described in the example of FIGS. 1 to 6.

If the attractive force of the magnet 17 might not be sufficient to ensure cohesion with regard to the movements parallel to the magnetic axis of the magnet, the snap-fitting projections such as 286 may be elongated along the internal edge of the walls 73 and 74 so as to retain also the internal pole piece 16.

We claim:

1. Electromagnet comprising an induction winding and first and second magnetic devices movable relative to each other, the first device comprising a core surrounded by the winding, the second device comprising an internal pole piece, relatively close to the winding and an external pole piece relatively far from the winding, a permanent magnet interposed between the external and internal pole pieces, the core bearing on at least one side of the winding a pole flange disposed in an air gap which is defined between the internal and external pole pieces, wherein an amagnetic cage is snap fastened on the external pole piece and comprises for the permanent magnet and for the internal pole piece respective recesses defined by means for positioning and retention with respect to displacements transverse to the magnetic axis of the permanent magnet.

2. Electromagnet according to claim 1, wherein as snap fastening means the cage comprises hooks engaged in recesses in the external pole piece.

3. Electromagnet according to claim 1, wherein the cage comprises two longitudinal walls between which the pole pieces and the permanent magnet are stacked.

4. Electromagnet according to claim 3, characterized in that each longitudinal wall has a recess in which is engaged an ear of the internal pole piece.

5. Electromagnet according to claim 1, wherein the cage comprises two cross pieces disposed between the pole pieces on opposite sides of the permanent magnet and locating the latter.

6. Electromagnet according to claim 1, wherein as to displacements parallel to the magnetic axis of the permanent magnet, the pole pieces and the permanent magnet are immobilized by the force of the permanent magnet.

7. Electromagnet according to claim 1, wherein on the side of the air gap, the cage has two flanges extending toward each other, which position the internal pole piece relative to displacements in a direction of narrowing of the air gap.

8. Electromagnet according to claim 1, wherein on the side of the internal pole piece remote from the air gap, the cage defines a recess for a magnetic lobe which is in magnetic contact with the external pole piece and which defines with the transverse region of the external pole piece an air gap in which there is relative mobility of a second pole flange of the core and of the external pole piece, between a position in which the second pole flange bears against the external pole piece and a position in which the second pole flange is adjacent the lobe.

9. Electromagnet according to claim 8, wherein the cage comprises a partition wall disposed between the lobe on the one hand and the magnet and the internal pole piece on the other hand.

10. Electromagnet according to claim 8, wherein the cage comprises snap fastening means maintaining the lobe in bearing contact against the external pole piece.

11. Electromagnet according to claim 8, wherein the induction winding comprises winding turns formed between two winding end flanges, and wherein the cage maintains the lobe such that its air gap face is substantially in the plane of one of the winding end flanges, and maintains the internal pole piece such that its air gap face is substantially in the plane of the other winding end flange.

12. Electromagnet according to claim 1, wherein the cage is of plastic material.

* * * * *